US009828120B2

(12) United States Patent
Kim et al.

(10) Patent No.: US 9,828,120 B2
(45) Date of Patent: Nov. 28, 2017

(54) MAKEUP FOUNDATION FILLING MACHINE

(71) Applicant: 3ATSM INC., Gyeonggi-do (KR)

(72) Inventors: Ou Soo Kim, Gyeonggi-do (KR); Min Soo Kim, Gyeonggi-do (KR)

(73) Assignee: COSMAXBTI, INC., Gyeonggi-Do (KR)

( * ) Notice: Subject to any disclaimer, the term of this patent is extended or adjusted under 35 U.S.C. 154(b) by 520 days.

(21) Appl. No.: 14/527,395

(22) Filed: Oct. 29, 2014

(65) Prior Publication Data

US 2015/0232208 A1 Aug. 20, 2015

(30) Foreign Application Priority Data

Feb. 18, 2014 (KR) ..... 10-2014-0018749

(51) Int. Cl.

| | |
|---|---|
| ***B65B 3/04*** | (2006.01) |
| ***B65B 39/00*** | (2006.01) |
| ***B65B 39/12*** | (2006.01) |
| ***B65B 43/48*** | (2006.01) |
| ***B65B 43/52*** | (2006.01) |
| ***B65B 43/54*** | (2006.01) |
| ***B65B 3/10*** | (2006.01) |
| ***B65B 3/30*** | (2006.01) |
| *A45D 37/00* | (2006.01) |
| *A45D 33/00* | (2006.01) |

(52) U.S. Cl.

CPC ..... *B65B 3/04* (2013.01); *B65B 3/10* (2013.01); *B65B 3/30* (2013.01); *B65B 39/004* (2013.01); *B65B 39/12* (2013.01); *B65B 43/48* (2013.01); *B65B 43/52* (2013.01); *B65B 43/54* (2013.01); *A45D 33/00* (2013.01); *A45D 37/00* (2013.01)

(58) Field of Classification Search

CPC ..... B65B 39/004; B65B 2039/009

See application file for complete search history.

(56) References Cited

U.S. PATENT DOCUMENTS

| | | | | |
|---|---|---|---|---|
| 4,953,600 | A * | 9/1990 | Tribert | B65B 3/04 141/1 |
| 9,415,558 | B2 * | 8/2016 | Na | B30B 11/14 |
| 2014/0170253 | A1 * | 6/2014 | Lee | A45D 33/00 425/84 |

FOREIGN PATENT DOCUMENTS

| | | |
|---|---|---|
| JP | 2014-115457 | 6/2014 |
| KR | 2020090006156 | 6/2009 |
| KR | 2004555600000 | 9/2011 |
| KR | 2020130003406 | 6/2013 |

* cited by examiner

*Primary Examiner* — Timothy L Maust
*Assistant Examiner* — Timothy P Kelly
(74) *Attorney, Agent, or Firm* — IPLA P.A.; James E. Bame

(57) ABSTRACT

A makeup foundation filling machine includes: container supplying means for supplying at least one container in which a puff is contained to a fixed position on a stage; elevating means having a flow pipe which is elevated above the container arranged at the fixed position by the container supplying means and pressing and transforming the puff in a state where the flow pipe gets in contact with the puff during a lowering action of the flow pipe; and foundation supplying means for supplying foundation of a fixed volume to the puff through the inside of the flow pipe in the state where the flow pipe directly gets in contact with the puff pressed and transformed while the flow pipe lowers by the elevating means.

8 Claims, 9 Drawing Sheets

MAKEUP FOUNDATION FILLING MACHINE

CROSS REFERENCE

This application claims foreign priority under Paris Convention to Korean Patent Application No. 10-2014-0018749, filed 18 Feb. 2014, with the Korean Intellectual Property Office.

BACKGROUND

The present invention relates to a makeup foundation filling machine, and more particularly, to a makeup foundation filling machine with an improved structure which can quantitatively fill the contents of makeup foundation of a fixed volume in a state where an edge part of a puff is pressed and a flow pipe directly gets in contact with the puff, thereby enhancing supply and productivity of makeup foundation and preventing makeup foundation from being sprayed outside a container or around a stage.

In general, women apply makeup using cosmetic products in order to make their faces beautiful and dazzle. Such cosmetic products can be divided into fundamental cosmetics, makeup cosmetics, cosmetics for hair, fragrances, medicated cosmetics, and so on according to their functions, and are divided into a cream state, a powder state and a liquid state according to their states and are stored in containers suitable for their states.

Particularly, cosmetic products, such as foundation, used as a makeup base are produced as finished products through the steps of: mixing binder, emulsifier and others to colored powder; melting the contents of the mixture at predetermined temperature; cooling the mixture; and putting the contents in cosmetic containers, such as foundation cases.

Such foundation must be applied to a wanted part (face or exposed skin) with a good sense of contact with the skin without any lump by evenly spreading on the wanted part and satisfy a sense of use and a sense of touch. So, a user uses a puff to evenly spread foundation on the wanted part and satisfy the sense of use and the sense of touch.

Such a puff is made of cotton, sponge, foamed NBR, polyester, nylon, acryl, or acetate, is formed in an elastic pad type, and is stored in a cosmetic container.

Alternatively, there is an absorptive puff in which foundation is absorbed into the puff so that the puff does not need a cosmetic container.

Such an absorptive puff has a porous structure to hold foundation therein. In order to manufacture such an absorptive puff, conventionally, a puff is deposited in a container in which liquid foundation is contained such that liquid foundation is naturally soaked into the puff. However, such a conventional absorptive puff has several disadvantages in that productivity of the absorptive puff is reduced because it takes much time to soak liquid foundation into the puff and in that quality of the product is deteriorated because liquid foundation is unevenly distributed into the puff.

Moreover, in order to soak liquid foundation into the puff, conventionally, the puff is deposited in the container in which liquid foundation is contained such that liquid foundation is soaked into the puff toward the center from the side which gets in contact with the liquid foundation. However, such a conventional absorptive puff also has several disadvantages in that there is a difference in volume and time that each puff absorbs liquid foundation and productivity is reduced due to decrease in production speed of the absorptive puff.

Furthermore, if deposit time of the puff is short, because liquid foundation is not soaked into the center of the puff, liquid foundation soaked into the puff is not evenly distributed. So, if the user applies makeup using the puff that liquid foundation is not evenly distributed, even though the puff comes into contact with the skin, because liquid foundation is not evenly coated on the skin, it cannot provides a beautiful makeup and it causes a deterioration in quality of the product.

In order to solve such problems, as an example of a conventional foundation filling machine, Korean Patent No. 10-1199256 discloses a "makeup for puff and manufacturing method thereof (granted on Nov. 2, 2012)". The method for manufacturing liquid makeup for a puff includes the steps of: supplying liquid makeup to the inside of a container; putting a porous absorptive member inside a container in which a makeup material is contained; pressing the absorptive member manually or using a press jig to forcedly absorb liquid makeup into the absorptive member; closing an inlet of the container, in which liquid makeup and the absorptive member are contained, with a cover having a receiving space; and fitting and assembling the puff into the receiving space of the cover.

Furthermore, the prior reference adopts a method to vibrate the press jig by operating a vibrator when the press jig presses the absorptive member, thereby enhancing filling efficiency of the makeup material.

However, because the prior reference uses a change in capacity of the absorptive member generated when the press jig presses the absorptive member, the prior reference has a disadvantage in that absorption efficiency of liquid makeup is decreased and it takes much time to absorb the liquid makeup into the absorptive member when the makeup material supplied to the lower side of the absorptive member is soaked into the absorptive member just by a pressing force of the press jig which presses the upper side of the absorptive member.

In order to solve the above-mentioned problem, Korean Patent No. 10-0970382 discloses "method and apparatus for absorbing foundation into puff" (granted on Jul. 8, 2010). In Korean Patent No. 10-0970382, the apparatus for spraying foundation into the puff includes: a stage on which a porous puff is seated; a foundation supplying unit for spraying foundation toward the puff seated on the stage; and a diffuser for diffusing foundation sprayed from the foundation supplying unit to the whole face of the puff.

Additionally, the apparatus for spraying foundation into the puff further includes a compressor disposed on a passage to which the diffuser is connected to increase pressure of the passage in the advancing direction of foundation.

The diffuser includes: a body connected with the foundation supplying unit; a partition plate mounted on the body; and jet holes radially arranged in the partition plate.

Such a manufacturing apparatus supplies liquid foundation into the puff using the foundation supplying unit, the diffuser and the compressor, but the manufacturing apparatus has several disadvantages in that foundation is sprayed not to the puff but to the stages to contaminate around the puff because foundation is sprayed at a position spaced apart from the puff and in that the puff must be exactly located at an elevation position of the diffuser in order to minimize contamination.

However, because the conventional puff is made of a relatively light material, it may be easily moved by external wind or vibration.

Therefore, in order to prevent movement of the puff, additional device for holding the puff on the stage is needed.

If the puff arranged in the additional device is made of a material which is expandable in volume when liquid foundation is absorbed, it is difficult to locate the puff inside a case.

Moreover, the conventional manufacturing apparatus has several disadvantages in that liquid foundation passing the puff is discharged to the air or contaminates around the stage because liquid foundation is sprayed and supplied to the puff and in that it needs additional device for removing the discharged foundation to prevent such phenomenon.

PRIOR REFERENCES

Prior Reference 1: Korean Patent No. 10-1199256 entitled "makeup for puff and manufacturing method thereof" granted on Nov. 2, 2012

Prior Reference 2: Korean Patent No. 10-0970382 entitled "method and apparatus for absorbing foundation into puff" granted on Jul. 8, 2010

SUMMARY OF THE INVENTION

Accordingly, the present invention has been made to solve the above-mentioned problems occurring in the prior arts, and it is an object of the present invention to provide a makeup foundation filling machine with an improved structure which does not adopt a conventional diffusion filling method through spraying to fill foundation and which can quantitatively fill the contents of makeup foundation of a fixed volume in a state where an edge part of a puff is pressed, thereby preventing makeup foundation from being sprayed outside a container or around a stage.

To accomplish the above object, according to the present invention, there is provided a makeup foundation filling machine including: container supplying means for supplying a container in which a puff is contained to a fixed position on a stage; a flow pipe having an outer flow pipe which is elevated above the container arranged at the fixed position by the container supplying means and gets in contact with the edge of the puff during a lowering action to prevent leakage of foundation when foundation of the fixed volume is supplied to the puff; elevating means for elevating the flow pipe; and foundation supplying means for supplying foundation of a fixed volume to the puff through the inside of the flow pipe in the state where the flow pipe directly gets in contact with the puff when the flow pipe lowers by the elevating means.

The flow pipe includes: a pipe body; an inner flow pipe which is arranged inside the pipe body and becomes a supply path of foundation; and an outer flow pipe which is arranged to the outside of an end portion of the inner flow pipe and presses the edge of the puff downwardly so as to prevent leakage of foundation when foundation of the fixed volume is supplied to the puff through the inner flow pipe.

The elevating means includes: a driving motor rotated when external electricity is applied; a driving shaft rotated by rotation of the driving motor; a lower platform connected to be elevated according to rotation of the driving shaft; and an upper platform which is connected to the lower platform to be interlocked with the lower platform via connection rods and is joined integrally with a pipe body to transfer the elevating power of the lower platform to the flow pipe.

The elevating means further includes auxiliary elevating means for separately elevating the outer flow pipe.

The auxiliary elevating means includes: an elevating cylinder having an elevating rod which is arranged above the pipe body and is vertically elevated by an external power source; a moving plate which is connected to an end portion of the elevating rod to be vertically elevated according to an elevating action of the elevating rod; an interlocking bar connected to the moving plate to be interlocked; and a support plate which is connected to the interlocking bar and supports the outer flow pipe to transfer the elevating power of the elevating rod of the elevating cylinder to the outer flow pipe.

The diameter of the outer flow pipe is 30 to 70% of the inner diameter of the container in which the puff is contained.

The inner flow pipe further includes a pressing disc disposed on the outer circumference of the lower part thereof.

The container supplying means includes: a supply conveyer for conveying container trays, on which the containers are respectively seated, in consecutive order; a discharge rod which is moved forward and backward by a cylinder to push and locate the container tray to the fixed position of the stage on the supply conveyer and to push and move foundation toward a discharge conveyer after foundation is supplied to the puff by the foundation supplying means; and the discharge conveyer for discharging the container trays transferred by the discharge rod in order.

Pressure to supply foundation to the puff through the inner flow pipe of the flow pipe is 0.3 to 1.5 kg/cm$^2$.

The makeup foundation filling machine according to an embodiment of the present invention does not adopt the conventional diffusion filling method through a nozzle to supply foundation but adopts a method to quantitatively fill the contents of makeup foundation of a fixed volume in a state where an edge part of the puff is pressed by an outer flow pipe and directly gets in contact with the puff, thereby enhancing productivity by simply supplying foundation of the fixed volume and preventing makeup foundation from being sprayed outside a container or around a stage to contaminate around the puff.

Additionally, because the diameter of the flow pipe is formed at the rate of 30 to 70% of the container, even though the puff is not located at the fixed position but is moved inside the container, the foundation filling machine can reduce malfunction when foundation is supplied because the flow pipe presses the puff in a state where the flow pipe directly gets in contact with the puff when the flow pipe lowers.

In addition, while liquid foundation is supplied in the state where the flow pipe directly gets in contact with the puff, it is prevented that the puff is adhered on an end portion of the flow pipe, such that the puff can be easily separated from the flow pipe.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
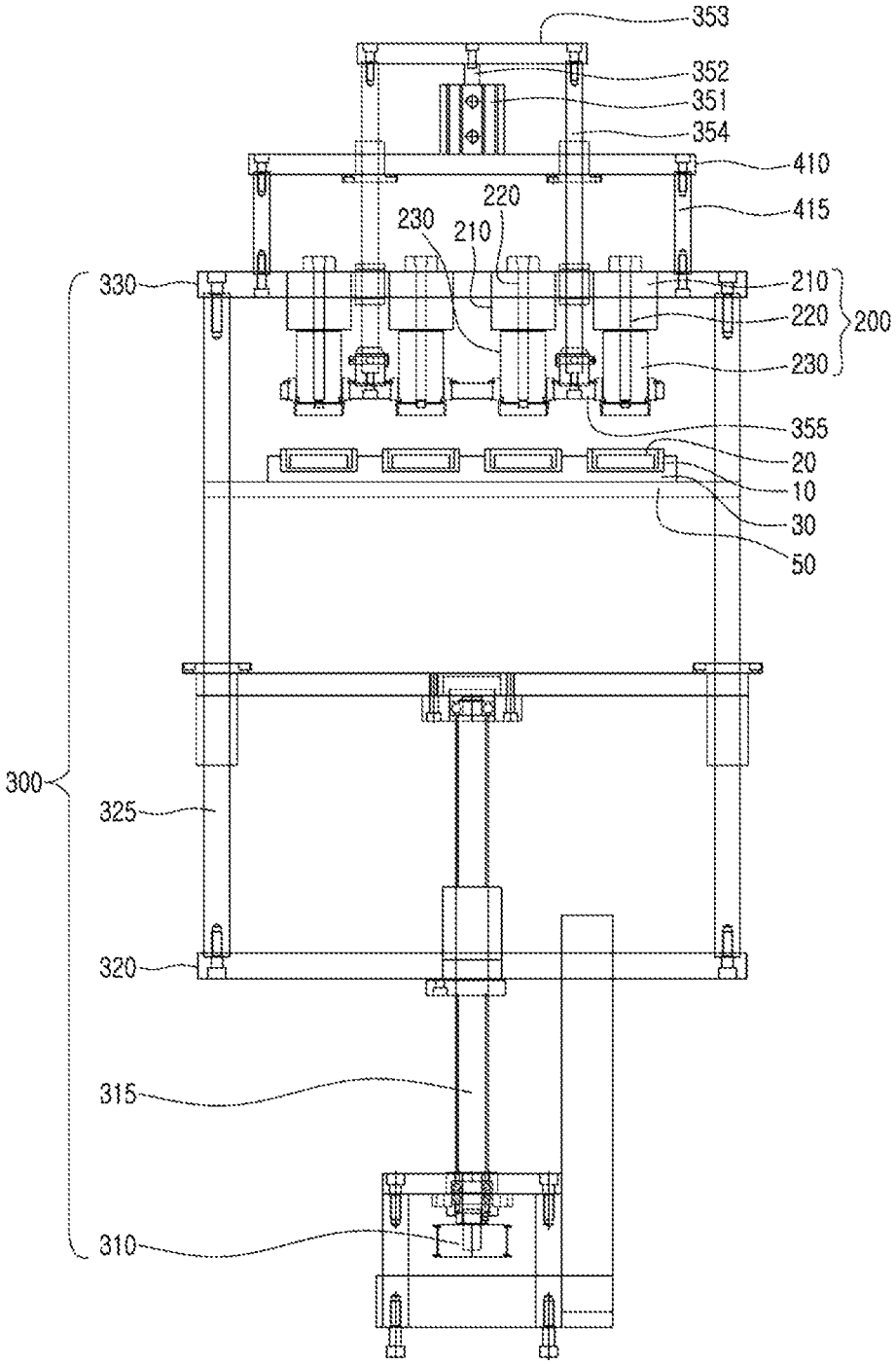
FIG. 1 is a configurative diagram showing a structure of a makeup foundation filling machine according to a preferred embodiment of the present invention.

Referring to FIGS. 1 to 9, a makeup foundation filling machine according to a preferred embodiment of the present invention includes: container supplying means 100 for supplying at least one container (10) in which a puff 20 is contained to a fixed position on a stage; a flow pipe 200 which is elevated above the container 10 arranged at the fixed position by the container supplying means 100; elevating means 300 for elevating the flow pipe 200 and making the flow pipe 200 come into contact with the puff 20 when the flow pipe 200 lowers after being elevated; and foundation supplying means for supplying foundation of a fixed volume to the puff 20 through the inside of the flow pipe 200 in the state where the flow pipe 200 directly gets in contact with the puff 20 when the flow pipe 200 lowers by the elevating means 300.

Referring to FIG. 1, the elevating means 300 includes: a driving motor 310 which is disposed below the stage 50 and rotates in forward and backward directions when external electricity is applied; a driving shaft 315 rotated by rotation of the driving motor 310; a lower platform 320 connected to transfer a rotational force of the driving shaft 315 through a vertical elevating power; and an upper platform 330 which is connected to the lower platform 320 to be interlocked with the lower platform 320 via connection rods 325, is joined integrally with a pipe body 210 to transfer the elevating power of the lower platform 320 to the flow pipe 200.

The driving shaft 315 is connected to the lower platform 320 in a screw type, such that the lower platform 320 is vertically elevated according to rotation of the driving shaft 315.

The connection rods 325 are vertically joined to edge parts of the lower platform 320 and the upper end portion of the connection rod 325 is connected to the lower side of the upper platform 330 to transfer the elevating power of the lower platform 320 to the upper platform 330.

Figure 2:
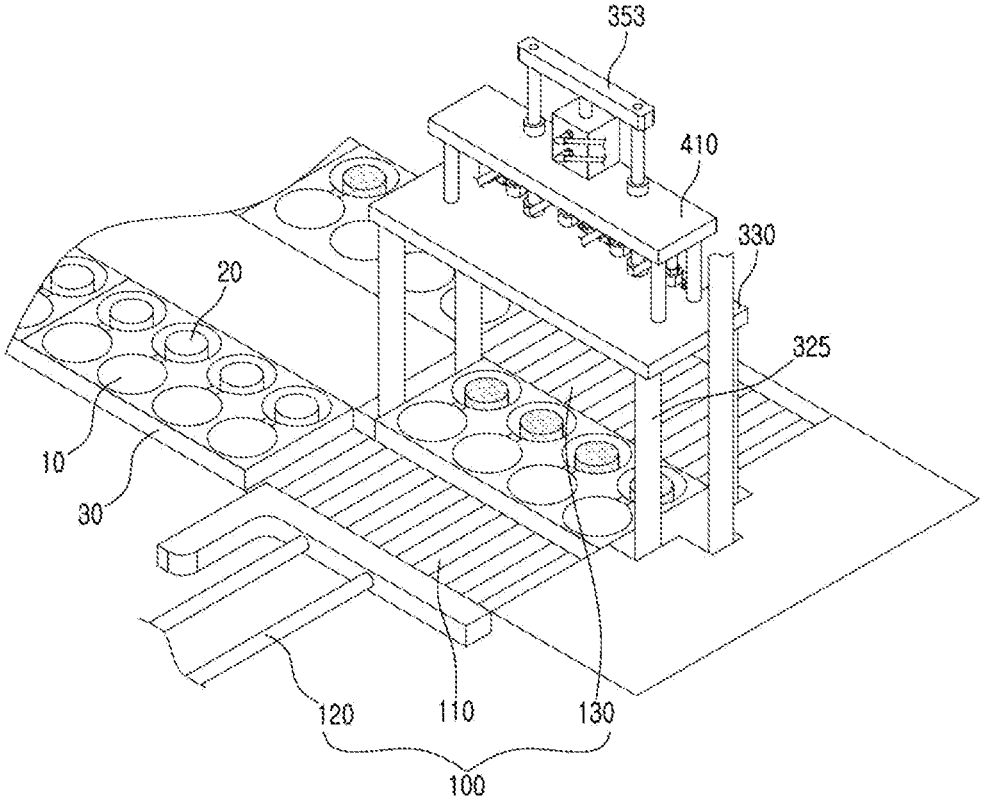
FIG. 2 is a rear perspective view of the makeup foundation filling machine.

Referring to FIG. 2, the container supplying means 100 includes: a supply conveyer 110 for conveying container trays 30, on which the containers 10 are respectively seated, in one direction in consecutive order; a discharge rod 120 which is moved forward and backward by a cylinder to push and locate the container tray 30 to the fixed position of the stage 50 on the supply conveyer 110 and to push and move foundation toward a discharge conveyer 130 after foundation is supplied to the puff 20 by the foundation supplying means 500; and the discharge conveyer 130 for conveying the container trays 30 transferred by the discharge rod 120 in the other direction to discharge the container trays 30 in order.

In this instance, because the plural containers are seated on the container tray 30 and foundation is supplied to the containers at the same time, foundation is supplied to a plurality of the puffs 20 so as to enhance productivity.

The stage 50 is located between the supply conveyer 110 and the discharge conveyer 130, and the flow pipe 200 is located above the stage 50.

Figure 3:
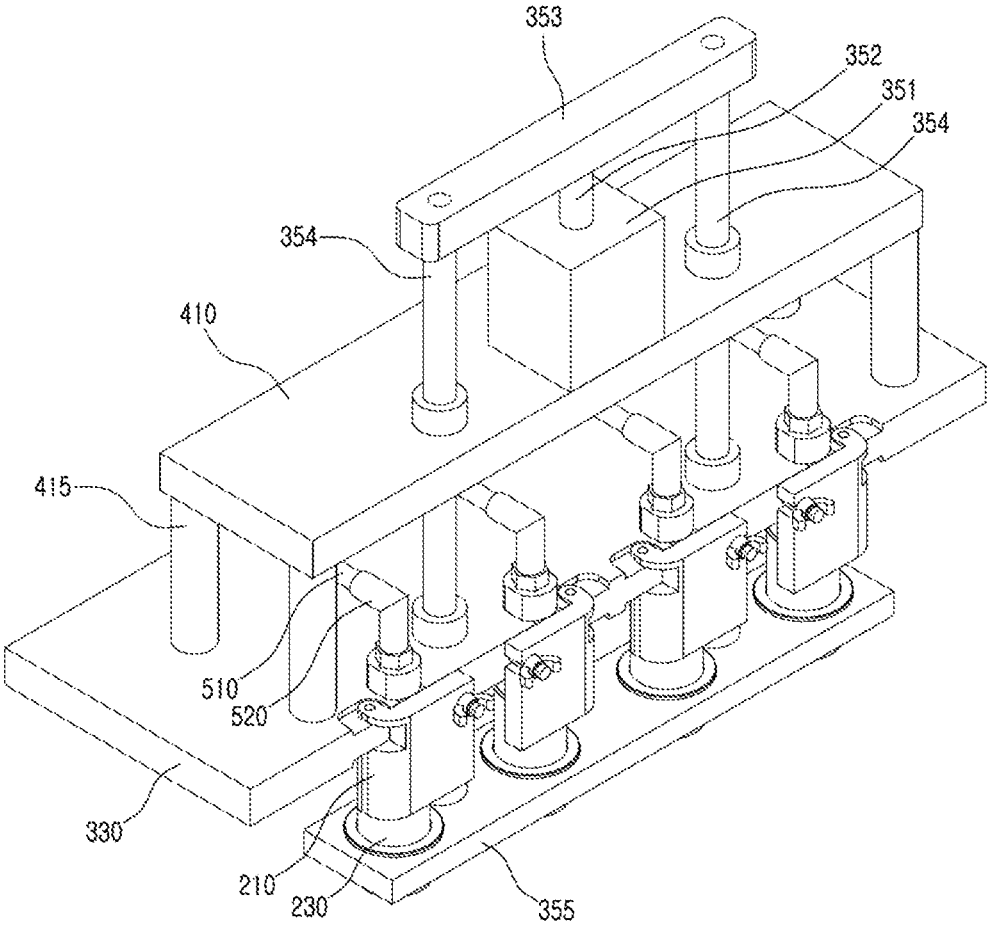
FIG. 3 is a perspective view showing a connection structure of a flow pipe of the makeup foundation filling machine.
Figure 4:
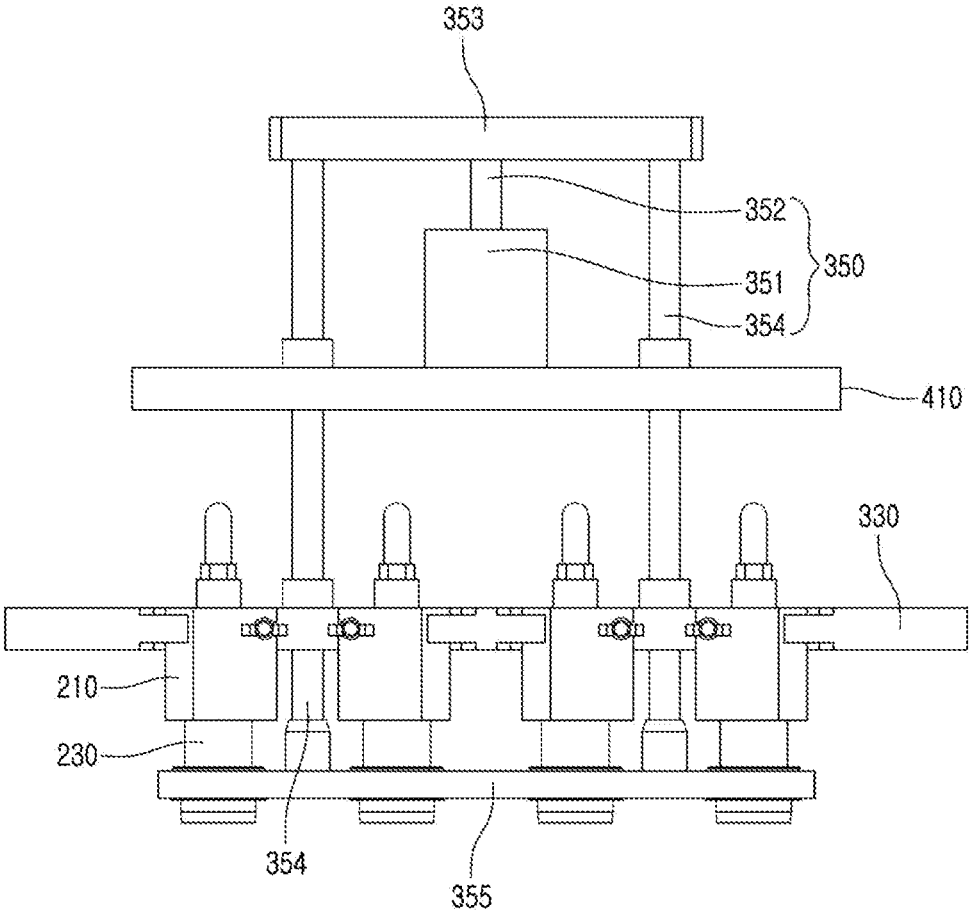
FIG. 4 is a front view of FIG. 3.
Figure 5:
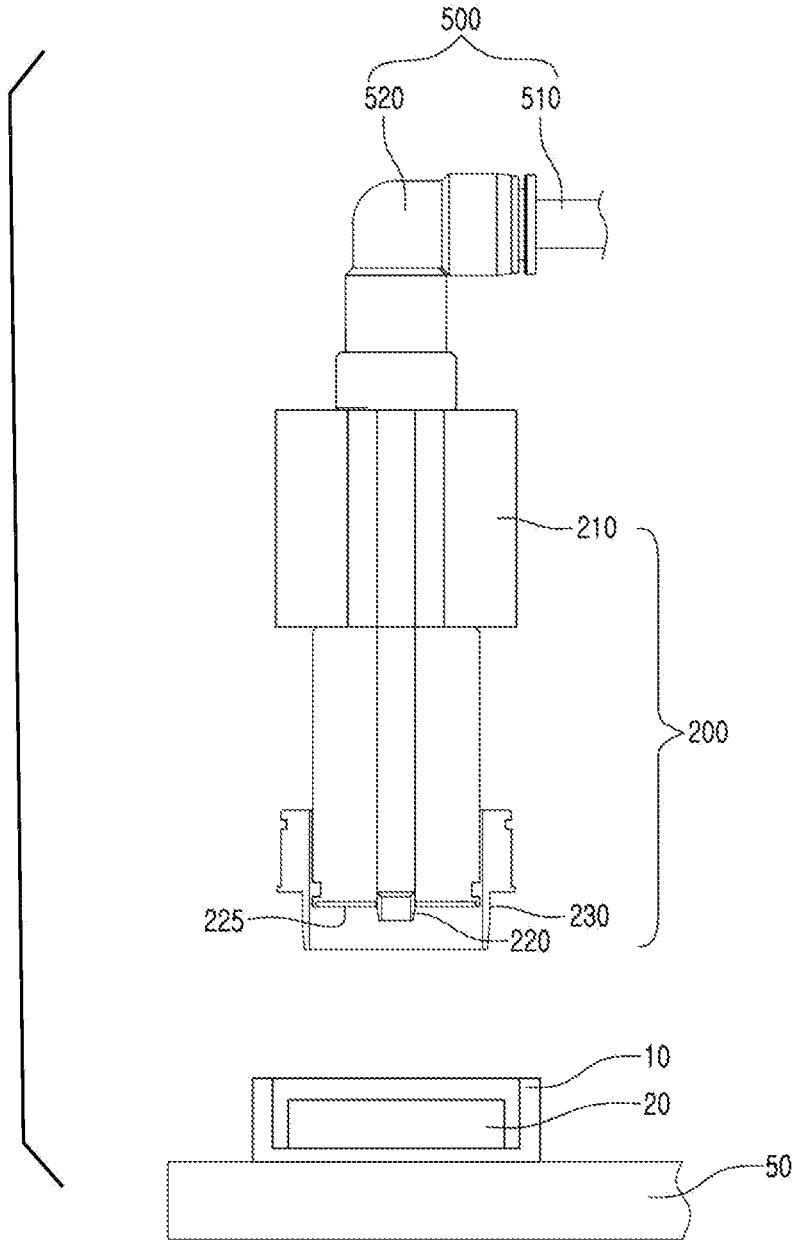
FIG. 5 is a configurative diagram schematically showing an arrangement state of the flow pipe and a container.

Referring to FIGS. 3 and 5, the flow pipe 200 includes: a pipe body 210 joined to an upper supporter; an inner flow pipe 220 which is arranged inside the pipe body 210 and of which upper part is connected with the foundation supplying means 500 to become a supply path of foundation; and an outer flow pipe 230 which is arranged to the outside of an end portion of the inner flow pipe 220 and presses the edge of the puff 20 downwardly so as to prevent leakage of foundation when foundation of the fixed volume is supplied to the puff 20 through the inner flow pipe 220.

It is preferable that the inner flow pipe 220 further include a pressing disc 225 disposed on the outer circumference of the lower part thereof.

The pressing disc 225 is arranged at a space between the inner flow pipe 220 and the outer flow pipe 230 in order to press the puff 20 when the flow pipe 200 presses the puff 20 and foundation is supplied and to smoothly supply foundation to the puff 20 located inside the outer flow pipe 230.

Moreover, it is preferable that the diameter of the outer flow pipe 230 is at the rate of 30% to 70% of the inner diameter of the container 10 in which the puff 20 is contained.

Because the puff 20 is contained in the container 10 to be able to move, if the diameter of the flow pipe 230 exceeds 70% of the inner diameter of the container 10, some of the outer circumference of the lower part of the outer flow pipe 230 is not located in a straight line of the puff 20 and the flow pipe 200 does not get in contact with the puff 20 and may be located in the space of the container 10 when the flow pipe 200 lowers. Therefore, some of foundation does not directly get in contact with the puff 20 while foundation is supplied and foundation may be leaked out of the container 10.

On the contrary, if the diameter of the flow pipe 230 is less than 30% of the inner diameter of the container 10, because the surface area of the puff 20 located inside the outer flow pipe 230 is small, supply efficiency of foundation supplied through the inner flow pipe 220 is reduced.

Referring to FIGS. 2 and 5, the foundation supplying means 500 includes: a supply hose 510 which becomes a path to supply liquid foundation from the outside; and a connector 520 for connecting the inner flow pipe 220 of the flow pipe 200 with an end portion of the supply hose 510.

The supply hose 510 is made of a flexible material to be interlocked according to the elevating action of the upper platform 330.

It is preferable that pressure to supply foundation to the puff 20 through the inner flow pipe 220 of the flow pipe 200 is 0.3 to 1.5 $kg/cm^2$.

If pressure to supply foundation to the puff 20 is less than 0.3 $kg/cm^2$, in the state where the end portion of the inner flow pipe 220 gets in contact with the surface of the puff 20, the foundation absorbing rate of the puff 20 is lowered. On the contrary, if pressure to supply foundation to the puff 20 exceeds 1.5 $kg/cm^2$, because foundation may run over the container 10 after passing the puff 20. Therefore, it is preferable that foundation is supplied to the puff 20 within a pressure range of 0.3 to 1.5 $kg/cm^2$.

Figure 6:
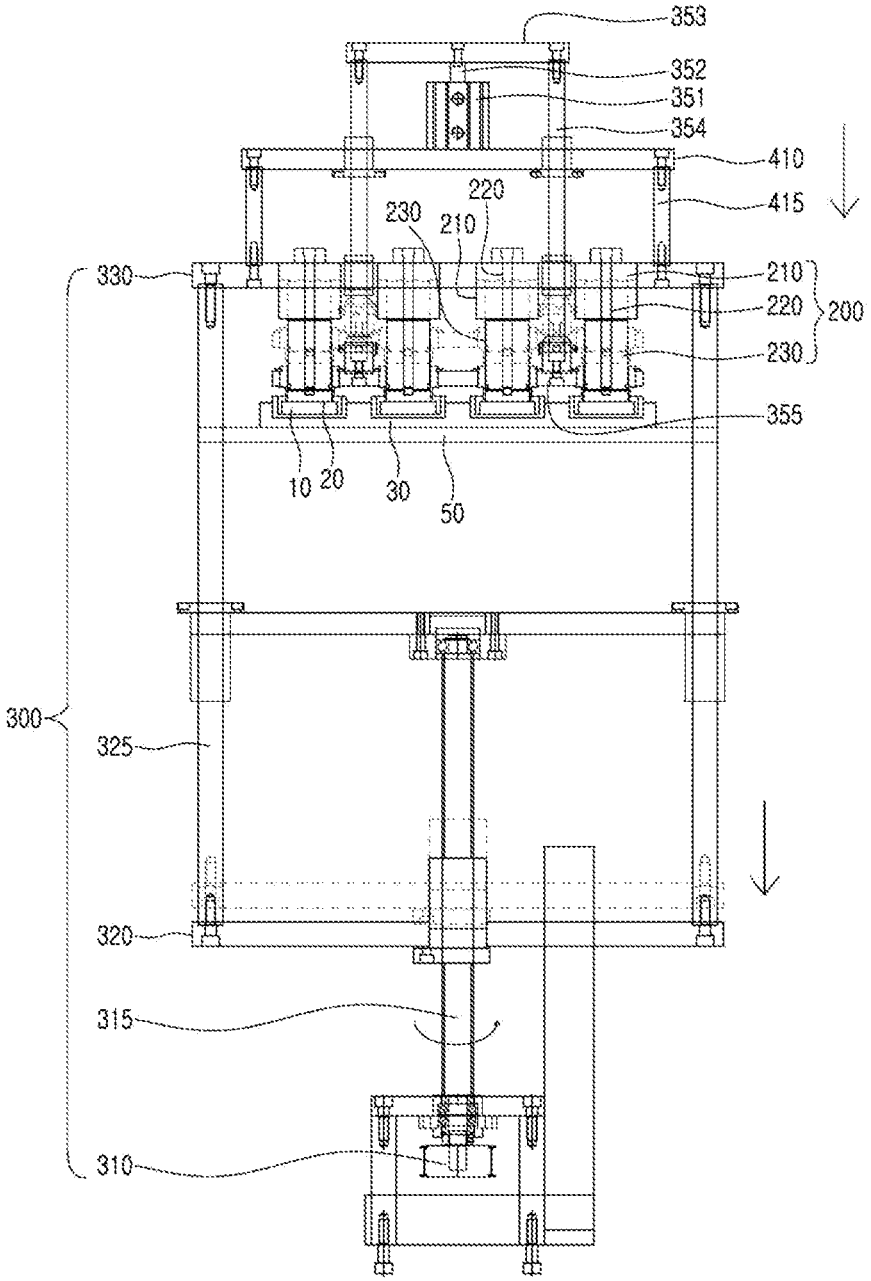
FIG. 6 is a view showing an operational state of elevating means of the makeup foundation filling machine.

Hereinafter, the operation of the elevating means 300 will be described. As shown in FIG. 6, when external electricity is applied to the driving motor 310, the driving motor 310 is rotated in one direction to rotate the driving shaft 315. After that, the lower platform 320 screw-coupled with some of the outer circumference of the driving shaft 315 lowers, and then, the upper platform 330 connected with the connection rod 325 is also lowered.

Continuously, the upper platform 330 which is lowering lowers the pipe body 210 of the flow pipe 200 to move the outer flow pipe 230 and the inner flow pipe 220 toward the container 10 seated at the fixed position of the stage 50, and then, the outer flow pipe 230 and the inner flow pipe 220 come into contact with the puff 20 contained in the container 10 to transfer the pressing power.

Figure 8:
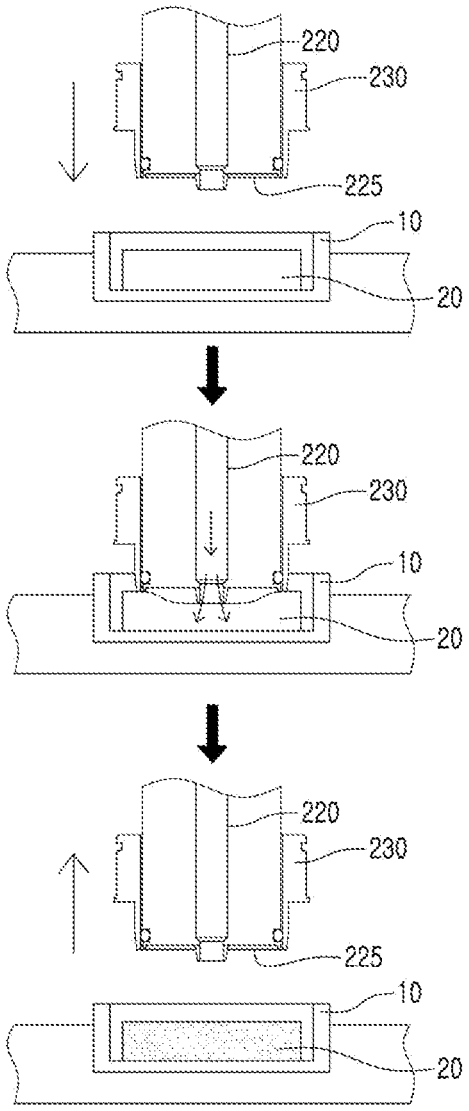
FIG. 8 is a use state view schematically showing a foundation filling process in order according to the preferred embodiment of the present invention.

Accordingly, as shown in FIG. 8, in a case that the lower part of the inner flow pipe 220 protrudes downwardly more than the lower part of the outer flow pipe 230, an end portion of the inner flow pipe 220 presses the central portion of the puff 20 to press the puff 20 into a concave form, and liquid foundation supplied from the foundation supplying means 500 is directly supplied to the upper surface of the puff 20 through the inside of the inner flow pipe 220.

Next, after liquid foundation is supplied to the surface of the puff 20, as time passes after the container 10 is completely packed, foundation is soaked into the puff 20 to be evenly distributed, and then, the puff 20 is expanded inside the container 10.

In this instance, the flow pipe 200 is elevated upwardly in order to return to its original position after liquid foundation is completely supplied to the surface of the puff 20. When the flow pipe 200 is elevated, even though the puff 20 is adhered to the elevated inner flow pipe 220, because a contact area between the puff 20 to which foundation is supplied and the inner flow pipe 220 is small, the puff 20 drops to the inside of the container 10 by self-weight, and hence, the puff 20 is not adhered to the flow pipe 200.

Moreover, according to another preferred embodiment of the present invention, in a case that the end portion of the inner flow pipe 220 is arranged inside the outer flow pipe 230, in order to prevent that the puff 20 is adhered to the flow pipe 200, the foundation filling machine according to the preferred embodiment of the present invention further includes auxiliary elevating means 350 for elevating the outer flow pipe 230.

Figure 7:
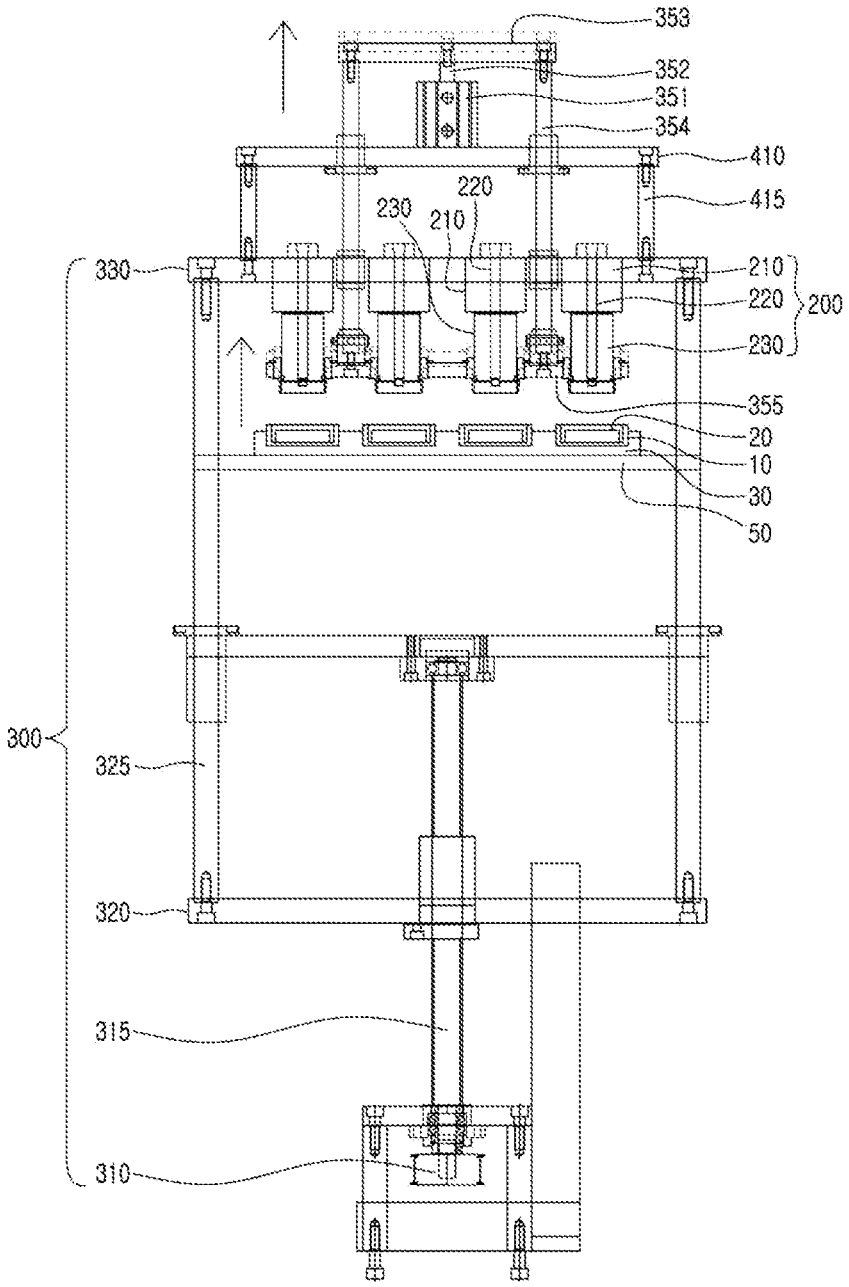
FIG. 7 is a view showing an operational state of auxiliary elevating means of the makeup foundation filling machine.
Figure 9:
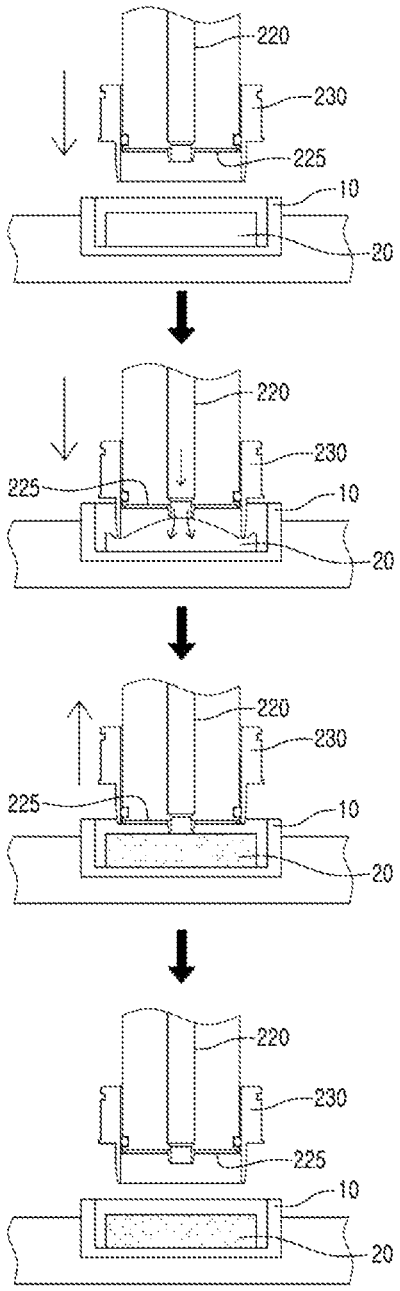
FIG. 9 is a use state view schematically showing a foundation filling process in order according to another preferred embodiment of the present invention

As shown in FIGS. 7 and 9, the auxiliary elevating means 350 includes: an elevating cylinder 351 having an elevating rod 352 which is vertically elevated by an external power source, such as hydraulic pressure or pneumatic pressure; a moving plate 353 which is connected to an end portion of the elevating rod 352 to be vertically elevated according to an elevating action of the elevating rod 352; an interlocking bar 354 connected to the moving plate 353 to be interlocked; and a support plate 355 which is connected to the interlocking bar 354 to support the outer flow pipe 230 and to transfer the elevating power of the elevating rod 352 of the elevating cylinder 351 to the outer flow pipe 230.

The elevating cylinder 351 is mounted on a fixed plate 410 arranged on the upper side of the upper platform 330 to be spaced via a fixed bar 415, and the elevating rod 352 is connected to the lower side of the moving plate 353 to vertically elevate the moving plate 353.

Next, the moving plate 353 transfers the vertically elevating power to the support plate 355 connected via the interlocking bar 354 to vertically elevate the support plate 355, and the outer flow pipe 230 is elevated when the support plate 355 is vertically elevated.

That is, the outer flow pipe 230 and the inner flow pipe 220 get in contact with the puff 20 contained in the container 10 and presses the puff 20 by the action of the elevating means 300, supply foundation of the fixed volume to the surface of the puff 20 using the foundation supplying means 500, and then, are returned to their original position. When the flow pipe 200 is returned to its original position, the outer flow pipe 230 is first elevated using the auxiliary elevating means 350, and then, the inner flow pipe 220 is elevated, such that it is prevented that the puff 20 is adhered to the end portions of the outer flow pipe 230 and the inner flow pipe 220.

In this instance, the auxiliary elevating means 350 for returning the flow pipe 200 elevates the elevating rod 352 of the elevating cylinder 351 to elevate the moving plate 353 and the support plate 355, and then, the outer flow pipe 230 joined to the support plate 355 is separately elevated.

After that, as described above, even though the puff 20 is adhered to the inner flow pipe 220 which is being elevated, because the contact area between the inner flow pipe 220 and the puff 20 to which foundation is supplied is small, the puff 20 drops to the inside of the container 10 by self-weight so as to be easily separated from the flow pipe 200.

Continuously, after the container 10 is completely packed, foundation supplied to the surface of the puff 20 is soaked into the puff 20 to be evenly distributed, and then, the puff 20 is expanded inside the container 10. In this instance, the expansion level of the puff 20 is varied according to materials of the puff 20.

Therefore, the makeup foundation filling machine according to the preferred embodiment of the present invention does not adopt the conventional diffusion filling method through a nozzle to supply foundation but adopts a method to quantitatively fill the contents of makeup foundation of the fixed volume in the state where the edge part of the puff 20 is pressed by the outer flow pipe 230 and directly gets in contact with the puff 20, thereby enhancing productivity by simply supplying foundation of the fixed volume and preventing makeup foundation from being sprayed outside the container 10 or around the stage 50 to contaminate around the puff.

Additionally, because the diameter of the outer flow pipe 230 is formed at the rate of 30 to 70% of the container 10, even though the puff 20 is not located at the fixed position but is moved inside the container 10, the foundation filling machine can reduce malfunction when foundation is supplied because the flow pipe 200 presses the puff 20 in the state where the flow pipe 200 directly gets in contact with the puff 20 when the flow pipe 200 lowers.

In addition, while liquid foundation is supplied in the state where the flow pipe 200 directly gets in contact with the puff 20, it is prevented that the puff 20 is adhered on the end portion of the flow pipe 200, such that the puff can be easily separated from the flow pipe 200.

What is claimed is:

1. A makeup foundation filling machine comprising:

container supplying unit (100) for supplying a container (10) in which a puff (20) is contained to a fixed position on a stage (50);

a flow pipe (200) having an outer flow pipe (230) which is elevated above the container (10) arranged at the fixed position by the container supplying unit (100) and gets in contact with an edge of the puff (20) during a lowering action to prevent leakage of foundation when foundation of the fixed volume is supplied to the puff (20);

elevating unit (300) for elevating the flow pipe (200); and foundation supplying unit (500) for supplying foundation of a fixed volume to the puff (20) through the inside of the flow pipe (200) in the state where the flow pipe (200) directly gets in contact with the puff (20) when the flow pipe (200) lowers by the elevating unit (300), wherein the flow pipe (200) comprises:

a pipe body (210);

an inner flow pipe (220) which is arranged inside the pipe body (210) and becomes a supply path of foundation; and the outer flow pipe (230) which is arranged to the outside of an end portion of the inner flow pipe (220) and presses the edge of the puff (20) downwardly so as to prevent leakage of foundation when foundation of the fixed volume is supplied to the puff (20) through the inner flow pipe (220).

2. The makeup foundation filling machine according to claim 1, wherein the elevating unit (300) comprises:

a driving motor (310) rotated when external electricity is applied;

a driving shaft (315) rotated by rotation of the driving motor (310);

a lower platform (320) connected to be elevated according to rotation of the driving shaft (315); and an upper platform (330) which is connected to the lower platform (320) to be interlocked with the lower platform (320) via connection rods (325) and is joined integrally with the pipe body (210) to transfer the elevating power of the lower platform (320) to the flow pipe (200).

3. The makeup foundation filling machine according to claim 2, wherein the elevating unit (300) further comprises auxiliary elevating unit (350) for separately elevating the outer flow pipe (230).

4. The makeup foundation filling machine according to claim 3, wherein the auxiliary elevating unit (350) comprises:

an elevating cylinder (351) having an elevating rod (352) which is arranged above the pipe body (210) and is vertically elevated by an external power source;

a moving plate (353) which is connected to an end portion of the elevating rod (352) to be vertically elevated according to an elevating action of the elevating rod (352);

an interlocking bar (354) connected to the moving plate (353) to be interlocked; and a support plate (355) which is connected to the interlocking bar (354) and supports the outer flow pipe (230) to transfer the elevating power of the elevating rod (352) of the elevating cylinder (351) to the outer flow pipe (230).

5. The makeup foundation filling machine according to claim 1, wherein the diameter of the outer flow pipe (230) is 30 to 70% of the inner diameter of the container (10) in which the puff (20) is contained.

6. The makeup foundation filling machine according to claim 1, wherein the inner flow pipe (220) further comprises a pressing disc (225) disposed on the outer circumference of the lower part thereof.

7. The makeup foundation filling machine according to claim 1, wherein the container supplying unit (100) comprises:

a supply conveyer (110) for conveying container trays (30), on which the containers (10) are respectively seated, in consecutive order;

a discharge rod (120) which is moved forward and backward by a cylinder to push and locate the container tray (30) to the fixed position of the stage (50) on the supply conveyer (110) and to push and move foundation toward a discharge conveyer (130) after foundation is supplied to the puff (20) by the foundation supplying unit (500); and the discharge conveyer (130) for discharging the container trays (30) transferred by the discharge rod (120) in order.

8. The makeup foundation filling machine according to claim 1, wherein pressure to supply foundation to the puff (20) through the inner flow pipe (220) of the flow pipe (200) is 0.3 to 1.5 $kg/cm^2$.

* * * * *